United States Patent [19]

Evers

[11] Patent Number: 4,643,309

[45] Date of Patent: Feb. 17, 1987

[54] FILLED UNIT DOSE CONTAINER

[75] Inventor: Hans C. A. Evers, Södertälje, Sweden

[73] Assignee: Astra Lakemedel AB, Sweden

[21] Appl. No.: 844,215

[22] Filed: Mar. 21, 1986

Related U.S. Application Data

[63] Continuation of Ser. No. 713,999, Mar. 20, 1985, abandoned, and a continuation-in-part of Ser. No. 461,594, Jan. 27, 1983.

[30] Foreign Application Priority Data

Feb. 8, 1982 [SE] Sweden ..... 8200720

[51] Int. Cl.[4] ..... B65D 73/00

[52] U.S. Cl. ..... 206/484; 206/364; 206/604; 215/32; 215/33

[58] Field of Search ..... 206/219, 221, 222, 364, 206/484, 498, 528, 604, 605; 215/32, 33, 247, 355; 220/307

[56] References Cited

U.S. PATENT DOCUMENTS

| | | | |
|---|---|---|---|
| 2,724,385 | 11/1955 | Lockhart | 206/364 |
| 2,747,574 | 5/1956 | Lorenzo | 206/364 |
| 3,083,858 | 4/1963 | Biedenstein | 215/32 |
| 3,144,966 | 8/1964 | Cook | 206/222 |
| 3,187,966 | 6/1965 | Klygis | 220/307 |
| 3,204,835 | 9/1965 | Michel | 215/32 |
| 3,261,381 | 7/1965 | Roach | 206/219 |
| 3,272,366 | 9/1966 | Ikeda | 215/32 |
| 3,325,860 | 6/1967 | Hansen | 18/5 |
| 3,330,282 | 7/1967 | Visser | 215/247 |
| 3,337,041 | 8/1967 | Damaskus | 206/364 |
| 3,356,244 | 12/1957 | Witchell | 215/32 |
| 3,509,879 | 5/1970 | Bathish et al. | 215/32 |
| 3,684,455 | 8/1972 | Vacirca et al. | 206/219 |
| 3,913,734 | 10/1975 | Siegel | 206/484 |
| 3,917,120 | 11/1975 | Larenz et al. | 206/484 |
| 3,957,168 | 5/1976 | Shine et al. | 215/32 |
| 3,967,728 | 7/1976 | Gordon et al. | 206/364 |
| 3,993,223 | 11/1976 | Welker, III et al. | 206/528 |
| 4,057,060 | 11/1977 | Roth | 206/364 |
| 4,125,186 | 11/1978 | Meierhoefer | 206/221 |
| 4,209,096 | 6/1980 | Charkhoff | 206/484 |
| 4,226,328 | 10/1980 | Beddow | 206/364 |
| 4,248,236 | 2/1981 | Linder | 206/364 |
| 4,366,901 | 1/1983 | Short | 206/364 |
| 4,410,096 | 10/1983 | Paradis | 215/32 |
| 4,463,862 | 8/1984 | Hansen | 215/33 |

*Primary Examiner*—William Price
*Assistant Examiner*—David T. Fidei
*Attorney, Agent, or Firm*—Brumbaugh, Graves, Donohue & Raymond

[57] ABSTRACT

The invention relates to a filled, thermoplastic unit dose injection solution container the outlet opening of which is sealed. The outlet opening is designed to fulfill the specifications for a standardized female cone intended to be non-leakingly connected to a correspondingly standardized male cone of a syringe in order to transfer the injection solution directly into the syringe. The unit dose container is preferably non-resealably sealed.

10 Claims, 6 Drawing Figures

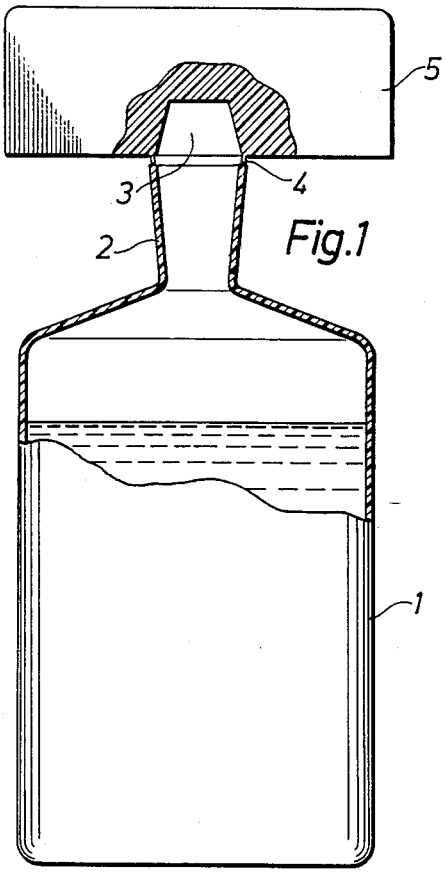
Fig.1
Fig.2
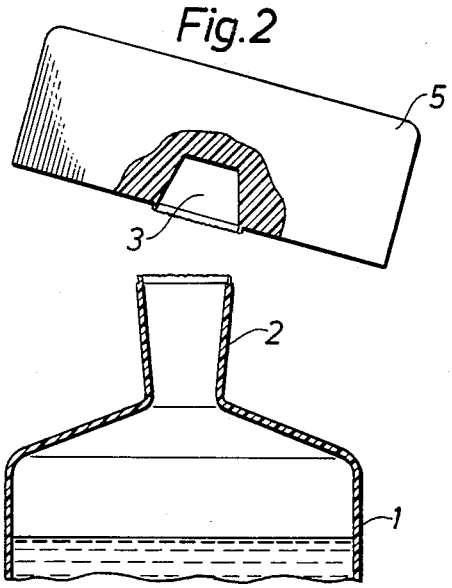
Fig.3
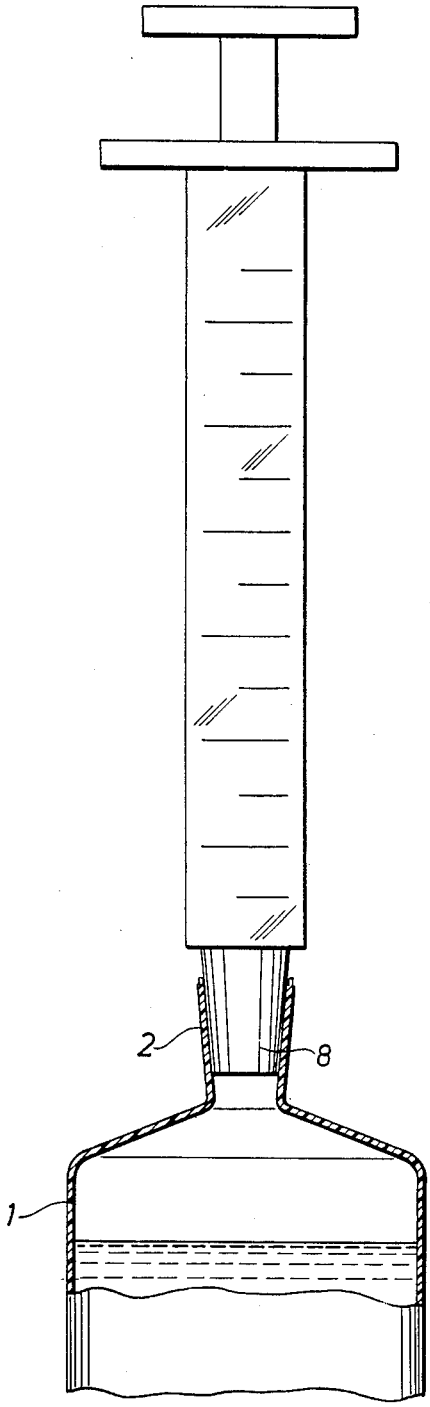

FILLED UNIT DOSE CONTAINER

This application is a continuation of application Ser. No. 713,999, filed on Mar. 20, 1985 now abandoned and a continuation-in-part of Ser. No. 461,594, filed on Jan. 27, 1983.

TECHNICAL FIELD

The present invention relates to a filled thermoplastic unit dose injection solution container the outlet opening of which is sealed. A unit dose container of this kind is easy to prepare and brings about many advantages as to for instance sterility, identification etc.

BACKGROUND ART

Injection solution, for instance to obtain local anesthesia within surgery or veterinary medicine, is normally stored in a glass vial being permanently sealed with a thick latex membrane as a sterility cover. The vial generally contains injection solution for several doses. The injection solution is transferred to a syringe by means of a thick withdrawal needle which is fitted on to the inlet opening of the syringe which is often designed as a male Luer cone. Subsequently, the latex membrane is sterilized by means of ethanol or the like whereupon the membrane is penetrated by the withdrawal needle and air is introduced under pressure into the vial by means of the injection syringe. Finally the volume desired of the injection solution is drawn into the syringe, the withdrawal needle is removed and replaced by a thinner injection needle and the solution is injected into the patient.

Unit dose containers for injection solutions are known, but the known unit dose containers, ampoules, are however intended to be inserted directly into an injection syringe of a special kind. They are made of glass and comprise both a penetratable membrane and a plunger. They are expensive to produce and are only suited for small volumes of injection liquid.

Thermoplastic unit dose containers sealed by means of a non-resealable cap are also known. The unit dose containers are however less adapted for injection solutions the sterility of which must be preserved also after the transfer into the injection syringe.

DESCRIPTION OF THE INVENTION

The object of the invention is to provide a filled thermoplastic unit dose injection solution container being easier to handle and safer to use than the present thermoplastic unit dose containers or latex sealed multidose containers. The unit dose container of the invention does not require a special withdrawal needle to transfer the injection solution into the syringe and in addition the heavy demands on sterility are complied with. These and other objects are achieved according to the invention in a surprisingly simple way by means of a unit dose container having the features stated in the following claims. The unit dose container of the invention is provided with an outlet opening designed to fulfil the specifications for a standardized female cone. This female cone is intended to be nonleakingly connected to a correspondingly standardized male cone of a syringe, whereby injection solution can be transferred directly from the container into the syringe.

BRIEF DESCRIPTION OF THE DRAWINGS

The invention will be further described below with reference to some embodiments shown on the accompanying drawing, wherein FIG. 1 shows a front view of a unit dose container of the invention, partly in section, sealed by a non-resealable cap;

FIG. 2 shows the unit dose container of FIG. 1 with the cap removed from the outlet opening;

FIG. 3 shows the unit dose container of FIG. 2 with a syringe connected to the outlet opening;

DESCRIPTION OF THE PREFERRED EMBODIMENTS

Figure 4:
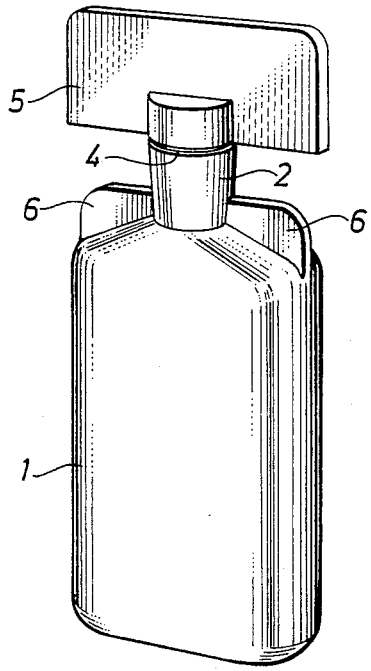
FIG. 4 shows a view in perspective of a special embodiment of the unit dose container of FIG. 1 provided with a projection.

In the embodiment of the invention shown in FIG. 1 a unit dose container 1 is provided with an outlet opening 2 having a surface and in the form of an outwardly widening truncated cone. The outlet opening 2 is sealed by a non-resealable cap 3. The purpose of making the cap non-resealable is among other things to ensure a complete disposability and sterile handling. The cap comprises a breaking line 4 indicating where the cap will be broken to expose the outlet opening of the container; see FIG. 2. In order to facilitate this breaking, in this case by means of a rotary motion, the cap 3 is provided with a planar, transversal tap or wing 5 giving an enlarged torsional movement at the breaking. This tab can also be used to display identification marks. The breaking line 4 is designed as a slot arranged along the periphery of the cap. It is of course possible to arrange the breaking line in other ways, for instance according to any known way where a breaking line in a cap is broken by a breaking movement instead of a torsional movement.

The outlet opening 2 is designed to fulfil the specifications for a standardized female cone, preferably a standard Luer female cone having a conicity of 6:100 or a Record female cone having a conicity of 1:10. The female cone is intended to be connected to a standard male cone 8 of an injection syringe, as is shown in FIG. 3. This connection of conical fittings makes it possible to transfer injection solution directly into the syringe without any intermediate steps or means. The female cone preferably has a maximum opening diameter smaller than 1.0 cm, preferably from 0.2 to 0.8 cm.

In the embodiment shown in FIG. 4 the upper part of the unit dose container has been provided with an extra projection 6 to be used as a support in removing the cap by breaking the breaking line 4. Such a projection or support can alternatively be placed in the lower part of the unit dose container, provided that the wall of the unit dose container is stiff enough.

Figure 5:
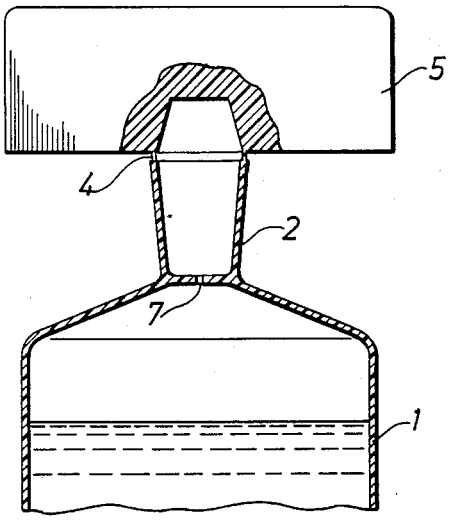
FIG. 5 shows a partial view in section of another embodiment of a unit dose container comprising a capillary constriction.

The embodiment of the invention shown in FIG. 5 is provided with a capillary constriction 7 below the outlet opening in order to prevent the outflow of the content of an opened container when being placed on the side or being kept upside down i.e. when the level of liquid is above the outlet opening.

Figure 6:
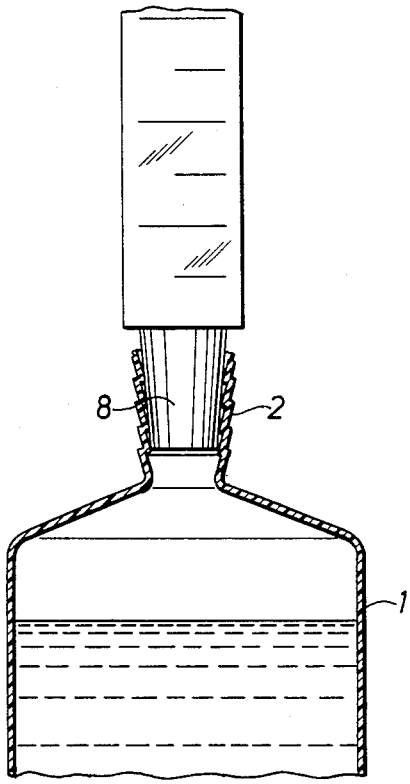
FIG. 6 shows a partial view in section of another embodiment of a unit dose container the outlet opening of which comprises circular grooves with a syringe connected thereto.

In FIG. 6 another preferred embodiment of the outlet opening 2 is shown in which the opening has been provided with peripherally arranged interior annular grooves across the outlet direction. Grooves of this kind apparently give improved sealing for syringe tip 8, especially if the outlet opening is made of a very thin and flexible plastic material. The plastic container according to the invention has the following advantages over ampoules or vials made of glass: (a) no need for a preservative in the solution, (b) easy to open, (c) no breakage, (d) no risk of glass particles or powder in the solution, (e) no rubber particles from penetrating rubber closure, (f) direct emptying into the syringe before attaching the needle, (g) no need to use a needle to extract the solution from the container, and (h) no risk of solution contamination.

It is advantageous if the bottom part or base of the container is designed so that a filled container can be placed upright and remain standing with the outlet opening turned upwards. This might be attained even when the wall of the container is so thin and flexible that the container collapses in drawing out the injection solution with a syringe, for instance if the container in its entirety is shaped as a truncated cone, a tetrahedron or the like. Such a thin and flexible wall is advantageous since the drawing of the injection solution into the syringe is then facilitated. In this case it will also be possible to fill the syringe by squeezing the unit dose container.

The unit dose container of the invention has a total inside volume of preferably 1–100 ml. It is conveniently filled with a standardized volume of injection solution of 1–50 ml, for instance 5, 10, 20 or 50 ml solution, or preferably somewhat more than a standardized volume as it in certain cases might be difficult to draw all the contents into the syringe. If the container is made with comparatively stiff walls it should moreover only be partly filled with injection solution. In a container of that type the pressure will be reduced which will render the drawing of the content into the syringe more difficult and this reduction of pressure should be compensated by a preceding injection of air and an accompanying increase of pressure of free air in the container.

The filled unit dose container according to the invention might be enclosed into a moisture impermeable bag. By this an undesired increase of the concentration of the injection solution, generally a water solution, by diffusion of water vapour through the thermoplastic wall of the dose container can be prevented. An additional purpose of the bag is to preserve the sterility of the container. The moisture impermeable bag is preferably made of a laminate of metal and plastic, for instance an aluminum-plastic-laminate. The bag preferably also can comprise one or more longitudinal breaking lines or tearing notches to facilitate the opening thereof. The bag normally is airtight and light impermeable and can thus also be used to protect the injection solution against oxidation and ultraviolet radiation. In this case it might be adequate to introduce an inert or reducing gas into the bag before it being sealed about the unit dose container.

The design of the unit dose container of the invention is such that it may well be produced by the very efficient so called "bottle-pack"-system. This system is among others described in the German Pat. No. 14 11 469 (Rommelag AG). The unit dose container is then formed by vacuum moulding and blowing and is then filled with liquid and sealed by a cap formed at the same time, the container still being left in the moulding tool. The liquid, that is the injection solution, then rapidly cools the formed container which consequently can be produced at a high speed. Finally the container is separated from the moulding tool and optionally enclosed into a moisture impermeable bag. These process steps can be accomplished under complete sterility. In order to ensure sterility of the outside of the container too it is appropriate to sterilize the final container, preferably by autoclaving.

An important advantage of this invention is that the positioning and dimensioning of the present invention lends itself to manufacture as described while at the same time resulting in a structure upon which the seal cap can be torn without deforming the Luer cone. This provides the first commercially practical container which can receive a standard Luer conical tip on an injection syringe without leakage.

To achieve this result, as shown in the drawings, the seal is a thinned section which surmounts the upper portion of the Luer cone opening in the dispensing vial and is set in the mid portion of the upper face of that cone, so that it is slightly offset from both lateral surfaces. Thereby tear fragments will not remain which interfere with the male Luer cones of the syringe. It is dimensioned relative to the thickness of the female Luer cone on the container so that the seal will separate by tearing, as shown in FIG. 2, without causing permanent deformation of the cone. Preferably the cone and seal are made of the same plastic material.

The unit dose container is made of a thermoplastic, such as polypropylene or polyethylene, preferably polypropylene.

The unit dose container of the invention can be filled with a solution of any drug which is suited for injection, but is particularly advantageous to use for aqueous solutions of autoclavable local anesthetics, such as lidocaine, prilocaine, mepivacaine, bupivacaine, etidocaine, or other drugs which are used under conditions where the demands for easy handling and sterility are especially high.

What we claim is:

1. A filled thermoplastic solution container containing a single dose of a sterile medication for administration to a human or animal patient by injection using a hypodermic syringe comprising a syringe having a conical tip to which a hypodermic needle is attached, said container having a neck portion with an inner surface which has converging and diverging sections which intersect and define an orifice at their intersection, the diverging section extending outwardly from said orifice to a sealing zone which is larger in diameter than said orifice, and a non-reusable tear seal which extends over and is sealed to said sealing zone at a tear line, which tear seal thereby protects the inner surfaces of said converging and diverging sections and the contents of said container from contamination, the inner surface of said diverging section being shaped in the vicinity of said orifice for removably and tightly receiving the conical tip of said syringe to thereby form a substantially leak-proof seal between said diverging section and syringe tip when said syringe tip is inserted for filling said syringe, whereby said tear seal can be removed by tearing it away, while the portion of the divergent section in the region of the orifice intended to receive said conical tip maintains its shape whereby the conical tip of said syringe can be inserted thereto in a leak-proof connection between said container and said syringe through which connection the single dose of medication can be transferred directly from the container to the syringe and the container can be thereafter discarded.

2. The container according to claim 1, wherein the outlet opening has a maximum opening diameter smaller than about 1.0 cm.

3. The container according to claim 1, wherein the outlet opening is sealed by a non-resealable cap.

4. The container according to claim 3, wherein the cap comprises a transversal projection providing an increased moment for use in breaking the seal.

5. The container according to claim 4, wherein the container comprises a projection providing an increased moment for use in breaking the seal.

6. The container according to claim 1, wherein the container is enclosed in a moisture impermeable bag made of a laminate of metal and plastic.

7. A container according to claim 1 characterized in that the wall of the container is sufficiently thin and flexible that the container collapses to permit the injection solution to be drawn out by a syringe.

8. The container according to claim 1, wherein the inner surface of the outlet opening of the container has a shape to form a substantially leak proof seal with a standard Luer male cone of a syringe.

9. The container according to claim 1, wherein the container has a base opposite the outlet opening for supporting and holding the container in an upright position with the outlet opening upwards when the container is filled.

10. The container according to claim 1, wherein a wall with a capillary constriction is provided inside the container below the outlet opening, to prevent solution from flowing out of the container when the container is positioned having its opening below the level of solution in the container.

* * * * *